United States Patent [19]

Gschwender et al.

[11] 4,341,503

[45] Jul. 27, 1982

[54] PUMP FOR FLUID MEDIA

[75] Inventors: Alois Gschwender, Reichenbach; Wolfgang Renner, Maulbronn; Herbert Hahn, Stuttgart, all of Fed. Rep. of Germany

[73] Assignee: Flux-Geräte Gesellschaft mit beschränkter Haftung, Stuttgart, Fed. Rep. of Germany

[21] Appl. No.: 140,413

[22] Filed: Apr. 14, 1980

[30] Foreign Application Priority Data

Apr. 14, 1979 [DE] Fed. Rep. of Germany ..... 2915379

[51] Int. Cl.[3] ..... F04D 29/10

[52] U.S. Cl. ..... 415/112; 415/175

[58] Field of Search ..... 415/53 R, 112, 175

[56] References Cited

U.S. PATENT DOCUMENTS

| | | | |
|---|---|---|---|
| 1,285,644 | 11/1918 | Doble et al. | 415/112 |
| 1,851,513 | 3/1932 | Holmstrom | 415/53 |
| 2,819,675 | 1/1958 | Gilman | 415/53 |
| 2,921,533 | 1/1960 | Williams | 415/112 |
| 3,115,841 | 12/1963 | Tilson | 415/112 |
| 3,508,842 | 4/1970 | Lievens | 415/53 |
| 3,620,639 | 11/1971 | Gaffal et al. | 415/112 |

FOREIGN PATENT DOCUMENTS

| | | | |
|---|---|---|---|
| 2060275 | 6/1972 | Fed. Rep. of Germany | 415/53 |

*Primary Examiner*—Leonard E. Smith

*Attorney, Agent, or Firm*—Becker & Becker, Inc.

[57] ABSTRACT

A pump for fluid media, with an inner pipe or tube arranged in a housing. A drive shaft is journalled in the inner tube, and a rotor is arranged in the housing. The rotor has a main body which is secured to the drive shaft and is provided with conveying blades for the medium. The rotor has a turbine or pump operating counter to the transporting or conveying direction of the conveying blades. At least one passage is arranged in the main body and extends from the pressure side to the suction side of the rotor, with the passage being connected with a suction gap on the inner tube.

1 Claim, 2 Drawing Figures

PUMP FOR FLUID MEDIA

The present invention relates to a pump for fluid or liquid media, and has an inner pipe or tube arranged in a housing. A drive shaft is journalled in the inner tube, and the pump also has a rotor arranged in the housing. The rotor has a main body which is fastened on the drive shaft and is provided with conveying blades or vanes for the medium.

With a known pump of this type, the inner tube is arranged axially in a tubular housing. A drive shaft journalled in the inner tube has, at one end, a coupling for the drive, and at the other end has a rotor with conveying blades for the medium to be pumped. A shaft seal with a slip ring and a counter ring is located at the rotor-side end of the inner tube. The drawback of this pump is that in operation, leakage at the shaft seal can occur, for example by frictional heat or by chemically aggressive media. Under these circumstances, there exists the danger that for instance lubricating material escapes from the inner tube and mixes with the medium to be conveyed. A further disadvantage exists especially with chemically aggressive media when the latter, with the support of the conveying pressure, penetrate into the inner tube, since hereby the drive shaft bearings, which frequently comprise chemically unstable materials because of their arrangement behind the shaft seal, and also the coupling at the end of the drive shaft, can be damaged. Consequently, continuous control work must be carried out at the shaft seal, and repairs must be undertaken with corresponding replacement of individual parts.

Consequently, the object of the present invention is to improve a pump of the aforementioned type in such a way that, during pump operation, a penetration of the medium into the inner tube is prevented in a direction toward the drive coupling.

Figure 1:
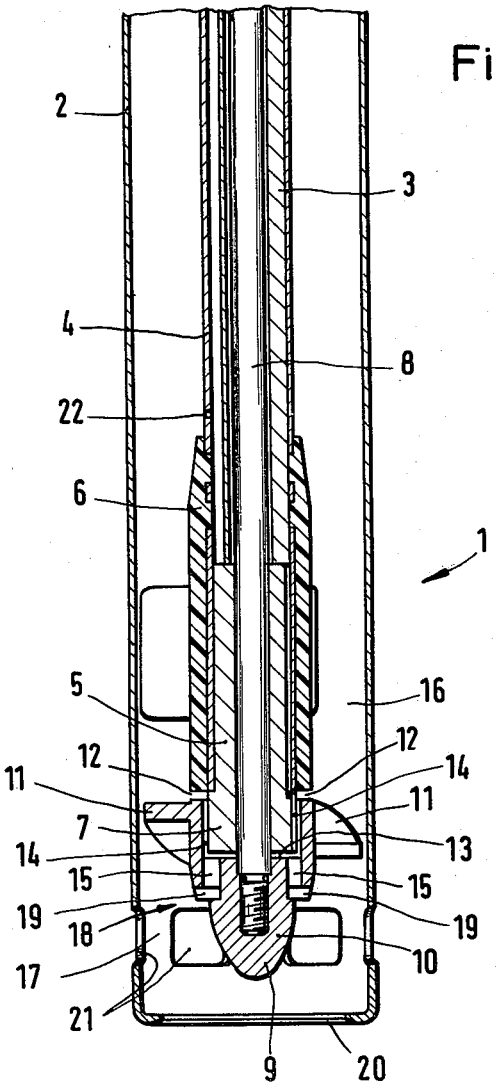
Figure 2:
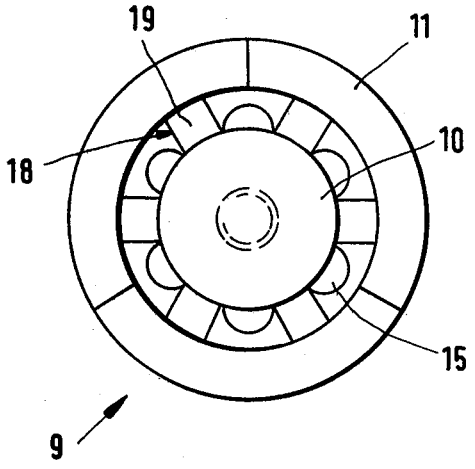

This object, and other objects and advantages of the present invention, will appear more clearly from the following specification in connection with the accompanying drawings, in which:

FIG. 1 is a schematic illustration of a part of a pump seen in a sectional side view; and FIG. 2 is a schematic illustration of a rotor according to FIG. 1 in an enlarged front view.

The pump of the present invention is characterized primarily in that the rotor has a turbine or pump which operates counter to the transporting direction of the conveying blades or vanes. In addition, at least one channel or passage is arranged in the main body and extends from the pressure side to the suction side of the rotor, with the passage being connected with a suction gap on the inner tube.

As a result, the advantage is attained that by way of the turbine arrangement a portion of the medium is suctioned or drawn from the pump chamber at the pressure side of the conveying blades through the suction gap and the passage back into the suction region of the conveying blades, so that a vacuum results in the inner tube. By means of this vacuum there is prevented a forward penetration or passage of the medium into the inner tube in a direction toward the drive coupling, since the underpressure effects a suction in exactly the opposite direction, so that a sealing function is provided without mechanical sealing parts, such as slide rings and the like, thus resulting in an arrangement which is completely free of maintenance and does not require any control measures.

Preferred arrangements of the present invention include that the end of the guide bearing on the rotor side is arranged in a bore of the main body, and a suction-gap extension is formed between the end of the guide bearing and the end of the wall of the bore. The passage is arranged in the plane of the suction-gap extension. The end region of the inner tube on the side of the rotor is embodied as a guide bearing. The guide bearing is arranged in a support sleeve which extends over the tube sleeve of the inner tube. The tube sleeve has an opening prior to that end face of the guide bearing which faces away from the rotor. The turbine or pump is formed by rotor blades arranged on the main body. The rotor blades are arranged on the suction-side end region of the passage. A passage is respectively arranged between each two rotor blades. By utilizing the aforementioned features in an advantageous manner, there is attained with simple means a highly effective vacuum-sealing function with operationally efficient turbine arrangement and flow return as well as reliable lubrication journalling or bearing means.

Referring now to the drawings in detail, the pump 1 has a housing 2, embodied as an outer tube or pipe, in which an inner tube or pipe 3 is axially arranged. The inner tube 3 is formed of a tube sleeve 4 and a guide bearing 5, and has a support sleeve 6 which extends over the guide bearing 5 as well as the tube sleeve 4, to which it is secured, whereby an end 7 of the guide bearing 5 projects beyond the support sleeve 6.

A drive shaft 8 is rotatably journalled in the inner tube 3 and has a coupling for a motor drive at that end part of the pump 1 not illustrated in the drawings. A rotatable rotor 9 is secured on the drive shaft 8 in the housing 2. The rotor 9 has a conically tapered main body 10 with conveying blades or vanes 11. A suction gap 12 is formed on the inner tube 3 between the main body 10 and the support sleeve 6. The main body 10 has a bore 13 in which the end 7 of the guide bearing 5 is journalled with play in such a way that a narrow suction-gap extension 14 is formed between the end 7 of the inner tube 3 and the wall of the bore 13. Channels or passages 15 are furthermore arranged in the main body 10; these passages 15 extend in the plane of the suction-gap extension 14, so that a connection exists between the pressure-side pump chamber 16 and the suction-side 17 by way of the suction gap 12, the suction-gap extension 14, and the passages 15. A turbine or pump 18 is provided on the rotor 9 at the suction-side end region of the passages 15. The turbine or pump 18 acts counter to the conveying blades or vanes 11. With the present embodiment, the turbine or pump 18 is formed by radial rotor blades 19 arranged on the base body 10. However, it is also within the scope of the present invention to carry out the turbine function by an inclined, slanted, or helical arrangement of the blades. It is especially recognizable from FIG. 2 that a passage 15 is arranged between each two rotor blades 19. The passages, however, can also be located in a region beyond the rotor blades, or several passages can be provided between adjoining rotor blades.

During operation of the pump 1, the fluid or liquid medium passes through the end face opening 20 and the side holes 21 into the suction-side chamber of the housing 2, and thus the fluid or liquid medium is pressed upwardly into the pump chamber 16 by the rotating conveying blades 11. Simultaneously, by means of the rotation of the counter-directed turbine or pump 18, a small portion of the medium is returned through the suction gap 12, the suction-gap extension 14, and the passages 15, so that, in the inner tube 3, an underpressure results, which brings about that the medium does not penetrate upwardly into the inner tube 3, but rather is withdrawn exclusively in an opposite direction from the inner tube 3, so that a reliable slide-ring-free sealing function is provided at the inner tube 3. Those pump parts which come into engagement with the medium, including for instance the housing 2, the tube sleeve 4, the guide bearing 5, the support sleeve 6, and the rotor 9, are, of course, for chemically aggressive media, made of suitably resistant material. Additionally, a permanent lubrication of the guide bearing 5 is attained by the suction effect of the turbine or pump 18 in that some fluid is suctioned through the opening 22 arranged in the tube sleeve 4 and is drawn toward the rotor along the drive shaft side of the bearing surface.

The present invention is, of course, in no way restricted to the specific disclosure of the specification and drawings, but also encompasses any modifications within the scope of the appended claims.

What we claim is:

1. A pump apparatus for fluid media, which comprises:

a housing;

an inner tube arranged in said housing in such a way that space remains between the inner wall of said housing and the outer wall of said inner tube;

a drive shaft journalled in said inner tube;

a rotor arranged in said housing and including a main body fastened on said drive shaft, said main body being provided with at least one passage extending from the pressure side of said rotor to the suction side thereof, with a suction gap being provided on said inner tube to allow communication between said at least one passage and said space between said housing and said inner tube;

conveying blades for medium, arranged on said main body;

a pump arranged on said rotor and operating counter to the transporting direction of said conveying blades, the pressure side of said rotor including a bore in said main body, and said inner tube including a guide bearing, one end of which is arranged in said bore, a gap serving as a suction-gap extension being provided between said guide bearing and the wall of said bore to effect said communication between said suction gap and said at least one passage, said at least one passage being arranged in the plane of said suction-gap extension, and being connected to said pump, said guide bearing being formed by that end of said inner tube directed toward said rotor, a tube sleeve around at least a portion of said inner tube, and a support sleeve in which said guide bearing is arranged, said support sleeve extending over a portion of said tube sleeve.

* * * * *